United States Patent [19]

Weiss

[11] Patent Number: 4,726,000

[45] Date of Patent: Feb. 16, 1988

[54] TIMEPIECE

[75] Inventor: Reinhold Weiss, Evanston, Ill.

[73] Assignee: Diehl GmbH & Co., Nuremberg, Fed. Rep. of Germany

[21] Appl. No.: 820,430

[22] Filed: Jan. 17, 1986

[30] Foreign Application Priority Data

Apr. 20, 1985 [DE] Fed. Rep. of Germany ... 8511806[U]
Oct. 10, 1985 [DE] Fed. Rep. of Germany ... 8528830[U]

[51] Int. Cl.[4] ..... G04B 19/04; G04B 19/06

[52] U.S. Cl. ..... 368/80; 368/223; 368/228

[58] Field of Search ..... 368/76, 80, 223, 228, 368/232, 238

[56] References Cited

U.S. PATENT DOCUMENTS

| | | | |
|---|---|---|---|
| 1,120,599 | 12/1914 | Christensen | 368/238 |
| 1,476,749 | 12/1923 | Yeomans | 368/228 |
| 1,768,100 | 6/1930 | Baumgarten | 368/228 |
| 3,022,626 | 2/1962 | Grow | 368/238 |
| 3,142,148 | 7/1964 | Morgan et al. | 368/238 |
| 3,763,648 | 10/1973 | Pakter et al. | 368/238 |

FOREIGN PATENT DOCUMENTS

| | | | |
|---|---|---|---|
| 2742242 | 3/1979 | Fed. Rep. of Germany | 368/80 |
| 310130 | 7/1933 | Italy | 368/238 |

*Primary Examiner*—Vit W. Miska
*Attorney, Agent, or Firm*—Scully, Scott, Murphy & Presser

[57] ABSTRACT

A timepiece including hour and minute hands of different configurations which are operated in a time-maintaining mode through the intermediary of a clockwork.

14 Claims, 5 Drawing Figures

TIMEPIECE

BACKGROUND OF THE INVENTION

Field of the Invention

The present invention relates to a timepiece including hour and minute hands of different configurations which are operated in a time-maintaining mode through the intermediary of a clockwork.

Timepiece of that type are currently widely sold in numerous commercial applications.

SUMMARY OF THE INVENTION

Accordingly, it is an object of the present invention to so develop and construct a timepiece of the type under consideration, which enables it to fulfill a new and useful purpose, especially within the context of obtaining a configuratively and decoratively new kind of effect, and in consequence thereof, to also be able to fulfill the most extensively increased demands on its precision in operation and accuracy in reading, as well as being produceable in widely differing configurations from only a few basic components.

The foregoing object is essentially achieved in a timepiece of the type under consideration, in which the hour and minute hands each possess the same length when observed facing in plan view towards the timepiece.

In accordance with the foregoing, in the configuration of the timepiece as a wall clock, as well as in its configuration as any kind of time-displaying implement (for example, in its configuration as consumer-oriented timepieces such as wristwatches or alarm clocks, or for instance in a configuration as technological timepieces, such as timers), there is obtained a completely unusual, uniquely interesting impression through the unusual equally lengthy construction of the hour and minute hands (and when present, also the seconds hand) which are clearly distinguished from each other through their widths; such as when these hands, pursuant to a further modification of the invention, rotate within a shallow cylindrical or circular depression, radially within or externally of the minute-scale display or arrangement which is located close below the plane of the glass of the timepiece, in which the bottom of the depression conforms to the plane of the dial face for usual watch or clock configurations. The hand which is of the greatest interest in the reading of a timepiece (in essence, normally the minute hand) can rotate radially adjacent the minute-scale arrangement in generally the plane thereof, or can terminate in that plane which facilitates a practically parallax-free reading or observation. Preferably, there is provided a unitary or single base component for the construction of this timepiece, the dial face area of which is determined through the position and dimensioning of a ring-shaped disc which carries the scaling array of the minute-scale arrangement, which can be simply exchanged in conformance with the instantaneous aesthetic demands, and which surrounds a depression within which there rotate the hands.

Especially apparent distinctions are obtained with the same basic configuration, when the ring-shaped dial face disc is arranged, alternatively, below the cover glass for the timepiece, which cover also extends over this disc; or is located in the plane of the glass for the timepiece so as to extend thereabout radially outwardly thereof. The central inner space of the area of the dial face plate can be concealed or covered by an exchangeable shield in the plane of the bottom of the depression, within which there rotate the hands, each of preferably the same length but possessing clearly differing widths.

The timepiece which incorporates such a base component can find utilization, for example, as a built-in module for technological timepieces or, for example, in table clocks or in many other usable objects, in which it is supported in an easily removable manner; for instance, through the intermediary of clamping elements arranged along the outer wall of a hollow space extending annularly rearwardly behind the support for the dial face plate, and within which there is retained close-fittingly, the clockwork mechanism for the time-maintaining motion of the hands.

BRIEF DESCRIPTION OF THE DRAWINGS

Additional alternatives and modifications, as well as further features and advantages of the invention, can now be readily ascertained from the following detailed description of exemplary embodiments thereof, taken in conjunction with the generally schematic representations in the accompanying drawings; in which.

DETAILED DESCRIPTION

Figure 1:
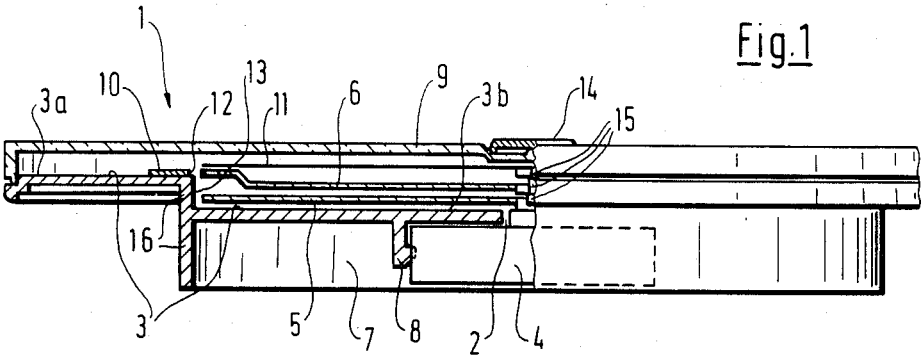
FIG. 1 illustrates a partially sectional side view of a wall clock, in which the equally lengthy hands rotate within the minute-scale arrangement in a degression in the dial face plate.

The clock 1 carries a clockwork 4 (socalled gear movement) at its rear, behind a central bore 2 in its dial face plate 3, for the time-maintaining operation of an hour hand 5 which circles in front of the dial face plate 3, and of a minute hand 6 which, in the viewing direction towards the clock 1, circles in a plane located in front thereof.

The clockwork 4 is mounted within a receiving space 7 which is formed at the rear on the dial face plate 3, for example, by means of a screw assembly or, in the illustrated case by means of resilient latching arms which cooperate with the sidewall of the clockwork 4. With regard to the term below the dial face plate 3, there is to be understood in connection in FIG. 1 up to FIG. 4 that this relates to the portion of the clock configuration which is visible, in the direction of viewing the clock 1, through the clock cover glass 9 thereof, underneath and adjacent the hands 5, 6, and which can be decorated, for instance, with coloring effects or graphics elements which are directly imprinted or applied thereon.

In the illustrated embodiment pursuant to FIG. 1, the dial face plate 3 concurrently serves as the carrier for the minute-scale display or arrangement 10 (within the context of the circular array of the minute-scale), which is illustrated excessively heavily for purposes of clarity in the cross-sectional view of the drawing figure. The minute-scale arrangement 10 can be, for example, imprinted thereon or plastically-shaped, for instance, applied in the form of independent structural elements.

Figure 3:
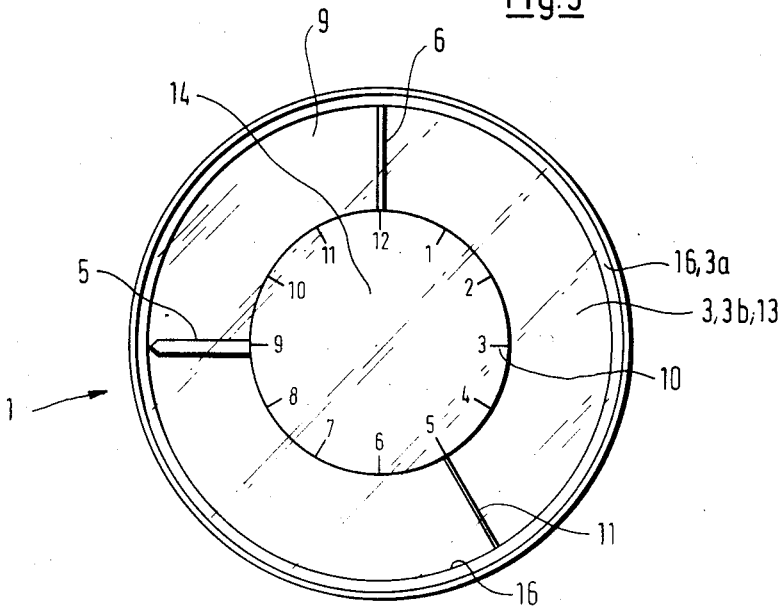
FIG. 3 illustrates a plan view of the clock pursuant to FIG. 2.

The hour hand 5 and the minute hand 6 are configured geometrically so as to be quite similar to each other. They distinguish from each other along the identical length which is observable through the clock glass 9 essentially due to their clearly differing widths. Hereby, the still overall slender hour hand 5 is by a multiple wider than the equally long minute hand 6. Preferably, as shown in FIG. 3, the hour hand 5 is configured or decorated in the region of its end so as to geometrically or ornamentally deviate from the minute hand 6. Any seconds hand 5 which may be present is also equally long, but is narrower than the minute hand 6.

The hands 5, 6, and 11 which are positioned in front of each other in the direction of viewing extend up to relatively close in front of a depression or indentation wall structure 16, in effect, in front of the circularly-shaped inner edge 12 of (an essentially ring-shaped geometrically configured) minute-scale arrangement 10. At least the plane of the rotational movement of one of the hands 5, 6 extends within a recess or depression 13, through which the dial face plate 3 is imparted pattern with a step in its cross-section (illustrated in FIG. 1 toward the left). The minute-scale arrangement 10 extends there along the inner edge of the front dial face plate region 3*a*, which extends from the plane of the rearward dial face plate region 3*b* outwardly towards a viewer; in effect, projecting towards the clock glass 9 flange-like or ring-shaped about the depression 13. The clock glass 9 lies closely above this forward dial face plate area 3*a*, inasmuch as, in particular, the hour hand 5 finds place in the shallow cylindrical depression 13 in front of the central rearward dial face plate region 3*b*. Preferably, the minute hand 6 (the most informative for the cursory time reading of the hands 5, 6, 11) moves, in every instance, with that partial area which most closely adjoins the minute-scale arrangement 10, in the plane of the minute-scale arrangement 10, which produces a parallax-free reading of the scale.

In the exemplary embodiment pursuant to FIG. 1 there is further provided a disc or plate 14 which is not moved by the clockwork 4, here is introduced into the external plane of the clock glass 9, for concealing from view the end surface of the indicator hand shafts 15 which traverse the dial face plate 3 through the central bore 12, and which can be concurrently applied as a decorative element contrasting with the impression from the glass 9.

Figure 2:
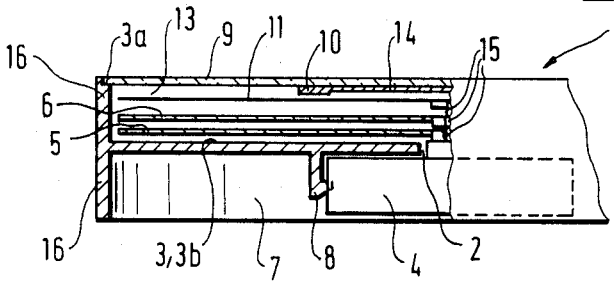
FIG. 2 illustrates partially sectional representation of a clock modified with regard to FIG. 1, in which the hands are visible externally of the minute-scale arrangement.

In the modified embodiment pursuant to FIG. 2, the frontal dial face plate area 3*a* is practically no longer existent; in effect, it is radially restricted to a narrow encompassing ring for the clamping attachment of the clock glass 9 in the region above the axially-parallel wall structure 16 which surround the space 7 for the clockwork and the depressions 13 for the hand planes. The minute-scale arrangement 10 is thus not arranged externally of the region traversed by the visible parts of the hands 5, 6, but is rather within this region; and namely, on a cover plate 14 which is radially considerably larger in comparison with that of the embodiment of FIG. 1.

In the exemplary embodiment pursuant to FIG. 2, this cover plate 14, in contrast with the conditions of FIG. 1, is no longer located on the viewable side of the glass 9, but rather on its rear side. The functioning of this cover plate 14 which carries the minute-scale arrangement 10 can also be realized in that there is provided, in the central region of the clock glass 9, an imprinting or lamination which is correlated with the distribution of the minute-scale arrangement 10 and, possibly, with numerical indicia. The larger cover plate 14 is, as a result, also advantageous inasmuch as there can be inserted the inner ends of the hands under its balancing extensions; so that there can be employed counterbalanced long hands 5, 6, 11 which can be operated by a low-powered electronic movement 4.

Again, the visible portion of the hands 5, 6 have the same length at clearly apparent differing widths, which extend close to the wall structure 16 of the depression 13 in the dial face plate. Because of the relatively large sized diameter of the cover plate 14 shown in FIG. 2, the hands 5, 6 (and if present, hand 11), as can be ascertained from FIG. 3, appear to the viewer through the clock glass 9 as spokes which extend radially between a trench-like circular ring 13 between the minute-scale arrangement 10 and the walls 16 of the depression. When the plate 14, in every instance, has the annular rim region which carries the minute-scale arrangement 10 depending into a plane which is offset into the depression 13, then in the interest of obtaining a parallax-free reading of the minute hand 6, it can possess a stepped extent, in order to extend adjoining the minute-scale arrangement 10 in the plane of the latter (not shown in the drawing).

In the illustrated clock or timepiece 1, the latter need not necessarily relate to a wall clock, but it can be the functional unit-equipped (with clockwork 4 and hands 5, 6, 11) standard insert component in wall clock, table clock, or fixed clock housings, or timers; in effect, time indicating apparatuses of the most different kinds of configuration. Hereby, in the instance of an electromechanical clockwork 4 with electronic time maintenance, the energy source may be in the form of a battery which, in a known manner, is arranged directly in the clockwork 4, or may be located in another area of the surrounding housing; when it is not replaced by another energy source; especially such as solar cells for the operation of the clockwork 4 through an energy storage.

Figure 4:
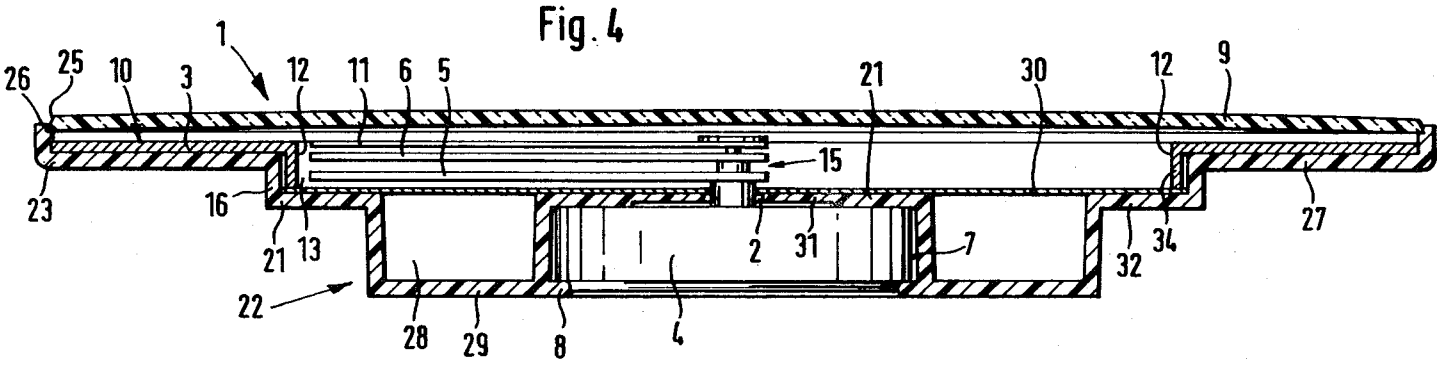
FIG. 4 illustrates a transverse sectional view through a clock with a clock glass which cover the entire viewing surface.
Figure 5:
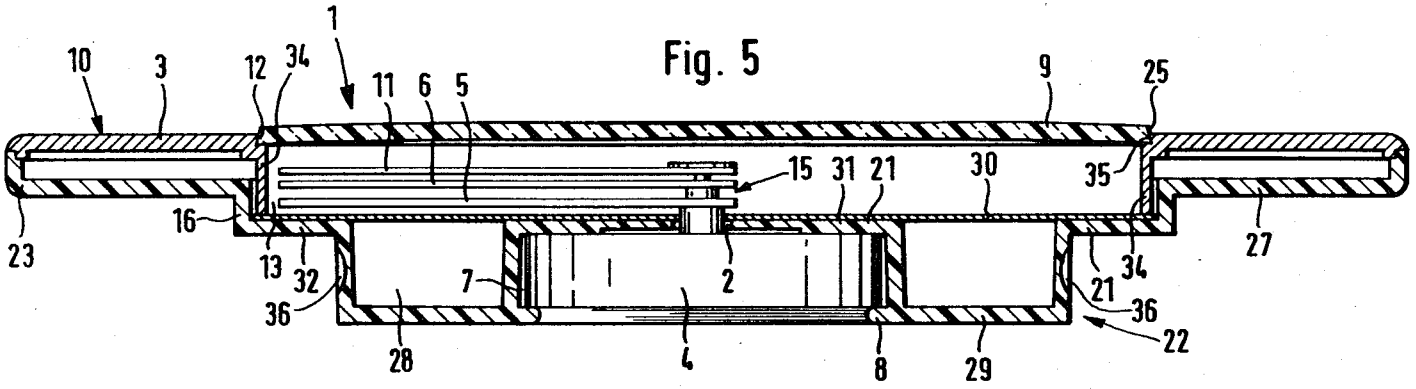
FIG. 5 illustrates a clock which maintains the housing base member pursuant to FIG. 1, with a dial face plate in the form of a ring-shaped disc extending radially outwardly about the clock glass.

Also the clock 1, pursuant to the drawings of FIGS. 4 or 5, carries a clockwork 4 at its rear, behind a central bore 2 in its dial face plate support 21; in effect, the gear mechanism for the time-maintaining operation of an hour hand 5 which rotates in front of the support 21 for the dial, and a minute hand 6 rotating in a plane in front thereof in the direction of view towards the clock 1. The clockwork mechanism 4 is retained within a receiving space 7 formed rearwardly on the support 21 for the dial face plate, for example, by means of a screw mounting or, in the illustrated exemplary case, by means of resilient latching arms 8 formed of resiliently-elastic plastic, rearwardly engaging by means of oppositely located parts of the sidewall of the clockwork 4, and which arms 8 are preferably directly integrally formed on the base member 22 forming the support 21 for the dial face plate.

These again equally long hands 5, 6, and 11 reach up to relatively close in front of a wall structure 16 of the depression; such that there is obtained a practically parallax-free reading capability, for example, of the minute hand 6, when the latter in accordance with FIG. 4 ends at least approximately in the plane of the minute-scale arrangement 10.

In the two embodiments of the clock 1, which are quite distinct from each other in the viewing direction in the embodiments of FIG. 4 and FIG. 5, the base member 22 which serves as the carrier 21 for the dial face plate is identically configured. Within the edge 23 of a socket portion 27 which is drawn plate-shaped from the plane of the clock glass 9, there is arranged an annular plate-like dial face plate 3 for receiving of the minute-scale arrangement 10; whose inner edge 12 determines the smaller outer diameter of the depression 13 which is visible from the front through the clock glass 9, in which there are retained and moved the hands 5, 6, 11 by their shafts 15 which are supported in the clockwork 4.

In the exemplary embodiment pursuant to FIG. 1, the clock glass 9 is retained along its periphery 25 in a form-fitted engagement in the axially-parallel protruding edge 23 of the base member 22; for example, radially snapped into an encompassing recess 26. Therebelow, the annular plate-like dial face plate 3, whose external diameter generally corresponds with the diameter of the clock glass periphery 25, is positioned within the edge 23 on the surrounding socket portion 27 which borders the depression 13 for the hands. The minute-scale arrangement 10 is formed on the viewable surface of this dial face plate 3, for example, imprinted, impressed, or represented by raised structural components. Basically, provision can be made to form the minute-scale arrangement 10 on the viewable surface of the socket portion 27; in effect, to configure this surface as the dial face plate 3; however, the embodiment illustrated in the drawing with a separate insertable ring-shaped dial face plate possesses the significant advantage that, at the remaining construction of timepiece 1 being identical (especially its rear base member 22), there can be inexpensively produced quite differently configured variants, in that there are simply made available different graphically configured or colored dial face plates 3, and depending upon need be inserted within the socket edge 23; prior to the clock glass 9 (a slightly elastically-deformable plastic glass) being snapped in. In order to reduce any reading difficulties caused mirror-reflective effects, at least the ring-shaped region of the glass 9 extending above the minute-scale arrangement 10 can be of a matted finish or be coated with an anti-reflective lacquer as is known from the optics technology.

In the interest of obtaining a configuratively responsive closed impression of the rear side of the base member 22 (after the clockwork 4 is inserted into the receiving space 7), the carrier 21 for the dial face plate is formed in the surroundings of the space 7 as a shallow annular or ring-shaped hollow space 28 with an annular plate-like bottom 29 in the plane of the resilient latching arms 8; however, open towards the depression 13 for the hands due to manufacturing reasons. This opening is covered by a circular disc-like shutter 30 which surrounds the shafts 15 for the hands, which in the neighborhood of the central bore 2 for the hand shafts, is positioned on the end wall 31 of the receiving space 7 for the clockwork, as well as at side of the hollow space 28 on the bottom 32 of the depression 13 for the hands, and from there extends radially up to about the wall 16 of the depression. The shutter 30 can be clamped radially at this location. However, instead thereof, or in addition thereto, along the inner edge 12 of the annular dial face plate 3 there can be formed an offset 34 which presses against the wall 16 of the depression, and in an axially-parallel extension in the form of a short hollow cylindrical wall presses the shutter 30 against the depression bottom 32. This offset 34, which is expediently integrally formed with the dial face plate 3, possesses along its inner mantle surface or visible surface preferably the same coloring as the visible side of the dial face plate 3; so as not to provide any aesthetically disturbing disruptions along the depression wall 16 towards the shutter 30 which, in its turn, is contrastingly colored for example, with regard to the dial face plate 3.

In the embodiment pursuant to FIG. 5, in contrast with the conditions of FIG. 1, the annular disc-shaped dial face plate 3 is no longer engaged below the plane of the clock glass 9, but is engaged somewhat in the plane thereof in the preflanged rim 23; and, in turn, the clock glass 9 (in conformance with the smaller diameter of its circumference 25) is engaged within a correspondingly encompassing recess 35 at the transition of the inner rim 12 of the dial face plate 3 with its surrounding offset 34. Obtained thereby, at the same basic construction, is a substantially different aesthetic impression in comparison with that of FIG. 4, inasmuch as the size of the clock 1 is visually determined through the surface of the clock glass 9; whereby any glass demirroring measures can be eliminated, since the minute-scale arrangement 10 is no longer covered over by the glass 9.

Consequently, in the embodiment of the clock 1 pursuant to FIG. 5, at the same diameter of the base member 22 the clock appears to be smaller, inasmuch as the location of the minute scale arrangement 10 lies outside of the circumference 25 of the clock glass 9, and is thereby located in an annular region, whose surface can be clearly differently structured than that of a clock glass 9.

A flat wall clock 1 of the illustrated type is preferably enclosed by a packing for its sale, which through a transparent viewing wall structure affords a view of the hour glass 9. In order to be able to easily and securely manipulate the flat clock 1 during its insertion into such a packing (not shown in the drawing), without thereby damaging or even only soiling its visible side, it can be expedient, as is only considered in FIG. 5 to provide the outer casing surface of the cylindrically projecting rearward part of the base member 22, with gripping depressions 36 which are offset relative to each other, or which are oppositely located (or possibly also fully surrounding), in which the fingertips will find a secure grip when the clock 1 is inserted into the packing or is again to be removed therefrom.

What is claimed is:

1. Timepiece including hour and minute hands possessing differing configurations; a dial face place structure; a clockwork operating said hands in a time-maintaining manner, said clockwork being supported on the rear of said dial face place structure, said hands displaying equal lengths in the direction of viewing towards said timepiece; a circular minute-scale arrangement, on said face place structure, said hands extending close to an inner circular edge of said minute-scale arrangement and at least one of said hands extending into proximity with said minute-scale arrangement in the plane of the latter, said dial face plate structure having a cylindrical wall structure forming a hollow cylindrical depression, said hands rotating within a narrow cylindrical space formed by said depression, and extending into close proximity with the hollow cylindrical wall structure of said depression.

2. A timepiece as claimed in claim 1, wherein the depression is surrounded by said minute-scale arrangement.

3. A timepiece as claimed in claim 1, comprising a clock glass covering said hands and having an opaque cover in the center thereof.

4. A timepiece as claimed in claim 2, wherein said depression annularly surrounds said minute-scale arrangement in a viewing direction facing the timepiece.

5. A timepiece as claimed in claim 1, comprising an opaque disc in the central region of the timepiece in a in front of said hands.

6. A timepiece as claimed in claim 5, wherein said minute-scale arrangement is provided along the edge region of said disc.

7. A timepiece as claimed in claim 1, wherein resilient latching arms retain said clockwork in a hollow space behind said dial face plate support, and a bottom closure for closing said hollow space in the region of the rear plane of the clockwork.

8. A timepiece as claimed in claim 3, wherein the support for the dial face plate comprise a base member with a laterial plate-like surrounding socket portion and an axially-parrallel protruding rim, and a disc-shaped dial face plate having an inner circular rim determining the diameter of the depression visible through said clock glass, and said hands rotating within the depression.

9. A timepiece as claimed in claim 8, wherein a shutter engages the support for the dial face plate within the inner cicular rim of the dial face plate at the bottom of the depression.

10. A timeplate as claimed in claim 9, wherein the dial face plate and the clock glass possess substantially equal diameters and are arranged above each other within the depression.

11. A timepiece as claimed in claim 9, wherein said clock glass is arranged generally in the plane of the dial face plate and is retained along the inner circular rim thereof.

12. A timepiece as claimed in claim 8, wherein a hollow cylindrical offset engages the inner circular rim of the dial face plate.

13. A timepiece as claimed in claim 12, wherein the cylindrical offset contacts the bottom of the depression, and a plate-like shutter being clamped by said offset.

14. A timepiece as claimed in claim 1, wherein said dial face plate support includes a base member with a rearward cylindrically projecting region, and gripping depressions formed in an outer casing surface of said base member to facilitate handling of said timepiece.

* * * * *

UNITED STATES PATENT AND TRADEMARK OFFICE

CERTIFICATE OF CORRECTION

PATENT NO. : 4,726,000

DATED : February 16, 1988

INVENTOR(S) : Reinhold Weiss

It is certified that error appears in the above-identified patent and that said Letters Patent is hereby corrected as shown below:

Column 2, line 24: "degression" should read as --depression--

Column 6, lines 56 & 59, Claim 1: "face place" should read as --face plate--

Column 7, line 11, Claim 5: "in a in front" should read as --in front--

Column 7, line 23, Claim 8: "laterial" should read as --lateral--

Column 7, line 24, Claim 8: "parrallel" should read as --parallel--

Column 8, line 7, Claim 10: "timeplate" should read as --timepiece

Signed and Sealed this

Sixth Day of September, 1988

*Attest:*

*Attesting Officer*

DONALD J. QUIGG

*Commissioner of Patents and Trademarks*